United States Patent [19]

Johnson et al.

[11] Patent Number: 5,010,915

[45] Date of Patent: Apr. 30, 1991

[54] TWO STAGE AUTOMATIC SHUT OFF VALVE

[75] Inventors: Bruce Johnson, Muskegon; Robert Whitney, Grand Haven, both of Mich.

[73] Assignee: EBW, Inc., Muskegon, Mich.

[21] Appl. No.: 534,442

[22] Filed: Jun. 6, 1990

[51] Int. Cl.[5] ..... F16K 31/22; F16K 33/00

[52] U.S. Cl. ..... 137/423; 137/400; 137/432; 137/448; 137/312; 141/128; 141/198; 251/149.9; 251/212

[58] Field of Search ..... 137/312, 400, 403, 423, 137/432, 445, 448; 141/86, 128, 198, 212, 213, 216; 222/68; 251/89.5, 149.9, 212

[56] References Cited

U.S. PATENT DOCUMENTS

| | | | |
|---|---|---|---|
| 2,299,360 | 10/1942 | Tharp | 137/448 |
| 2,569,110 | 9/1951 | McGillis et al. | 137/448 |
| 2,578,926 | 12/1951 | Douglas | 141/213 |
| 2,773,706 | 12/1956 | Leavell | 251/89.5 |
| 3,078,867 | 2/1963 | McGillis et al. | 137/448 |
| 3,732,902 | 5/1973 | Muller | 137/423 |
| 3,799,502 | 3/1974 | Baum | 251/212 |
| 3,963,041 | 6/1976 | McGillis | 137/404 |
| 4,266,582 | 5/1981 | Sergent | 137/423 |
| 4,667,711 | 5/1987 | Draft | 137/448 |
| 4,793,387 | 12/1988 | LeBlanc et al. | 137/312 |

*Primary Examiner*—George L. Walton
*Attorney, Agent, or Firm*—Basile and Hanlon

[57] ABSTRACT

A shut off valve assembly for preventing overfilling of an underground fuel storage tank or other storage tanks where the incoming flow is not metered, utilizes a two stage valve closure, the first stage closure signaling the tank is nearly filled to capacity and the second stage closure subsequently completely stopping flow into the tank.

15 Claims, 4 Drawing Sheets

TWO STAGE AUTOMATIC SHUT OFF VALVE

BACKGROUND OF THE INVENTION

The present invention is directed to a float actuated shut off valve for terminating the flow of fluid into a storage tank to prevent overfilling of the tank. The valve disclosed, while useful in other applications, is particularly well adapted for controlling the filling of underground fuel storage tanks such as are employed in service stations.

Underground fuel storage tanks utilized by service stations are filled via a fill pipe which extends upwardly from the top of the tank to a supply coupling located in a relatively shallow manhole in the service station apron. A supply hose from a tank truck is coupled to the supply coupling at the upper end of the fill pipe and, upon opening-of a shut off valve on the supply truck, fuel flows by gravity from the truck through the supply hose and fill pipe into the underground storage tank. Typically, neither the tank truck nor the underground storage tank are metered to provide a running indication of how much fuel has been dispensed into the tank during the filling operation. In theory, the delivery man is required to determine how much fuel is in the tank by inserting a dip stick into the tank through the fill pipe before coupling the supply hose to the fill pipe and is prohibited from coupling the fill pipe to a storage compartment in his truck tank which contains more fuel than the underground tank has room for. In practice, this last prohibition is almost universally ignored, and in the past, it was not an unknown practice to continue filling the underground tank until fuel started flowing out of the underground tank vent.

To prevent overfilling, many present day underground storage tanks are provided with a float actuated shut off valve which closes when the level of fuel within the underground tank rises to a preselected level, as, for example, when the tank is 95% full. Closure of these valves stops the incoming flow of fuel, but traps a substantial quantity, typically 25 to 30 gallons of fuel, in the supply hose between the float actuated shut off valve at the fill pipe inlet and the shut off valve on the tank truck. One solution to this problem is to provide an overfill storage container at the upper end of the fill pipe—see, for example, U.S. Pat. No. 4,793,387—into which the supply hose can be drained and the drained fuel subsequently drained from the overfill container into the underground tank when sufficient fuel has been withdrawn from the tank.

The basic problem with float actuated shut off valves is that while they prevent the filling of the underground storage tank beyond its capacity, they do not solve a main problem created by overfilling—namely the trapping of 25 or 30 gallons of fuel in the supply hose between the fill pipe and the shut off valve on the tank truck.

The present invention is directed to a solution to this last problem.

SUMMARY OF THE INVENTION

In accordance with the present invention, a float actuated automatic shut off valve is arranged to act in two stages. In the first stage of actuation, a first flapper valve is shifted to its closed position in response to the elevation of a first float above a predetermined level by the rising of the fuel level within the underground storage tank. The first flapper is so designed that it does not completely close the fuel flow passage but instead blocks about 90% of the cross sectional flow area of the passage. This sudden restriction to flow is sufficient to cause a water hammer effect audible to the fuel delivery man and visibly manifested by a jerking of the supply hose. This tells the delivery man that the underground storage tank is nearly—for example, 95%—full and that the rate of flow of fuel into the tank has been reduced to approximately 10% of the full flow rate.

Upon continued flow of fuel into the tank, the rising fuel will elevate a second, independent, float to actuate a second flapper which will close the remaining open portion of the flow passage to completely stop the flow of fuel into the tank. The difference in fuel levels at which the first and second flappers are actuated may be chosen such that a known time period at the reduced flow rate will elapse between actuation of the first flapper closure and actuation of the second flapper closure. This affords the delivery man sufficient time to actuate the tank truck shut off valve prior to closure of the second flapper so that fuel delivery can be shut off at the tank truck in time to let all fuel downstream of the tank shut off valve to drain directly into the underground storage tank before the supply hose is uncoupled.

The valve assembly of the present invention takes the form of a valve housing adapted to be threadably mounted at the upper end of the fill pipe. An elongate hollow drop tube extends downwardly from the valve housing freely through the fill pipe and downwardly into the underground storage tank. At the lower end of the drop tube, two hollow cylindrical floats are slidably received on the exterior of the drop tube one above the other, the outer diameter of the floats being less than the inner diameter of the fill pipe to enable simple installation of the valve assembly in existing underground storage tanks. Actuating rods extend upwardly from the lower and upper floats into the valve housing to be respectively coupled to the actuating linkages for the first and second valve flappers referred to above. The rod from the lowermost of the two floats passes freely through a lengthwise bore through the side wall of the uppermost float. To prevent inadvertent coupling of a supply hose to a storage tank which is substantially full, a third float actuated rod may be employed to project a lock out pin from the supply hose coupling section of the valve housing which will prevent coupling of the supply hose to the valve housing unless the fuel level in the underground tank is below a predetermined level.

Other objects and features of the invention will become apparent by reference tO the following specification and to the drawings.

IN THE DRAWINGS

Figure 1:
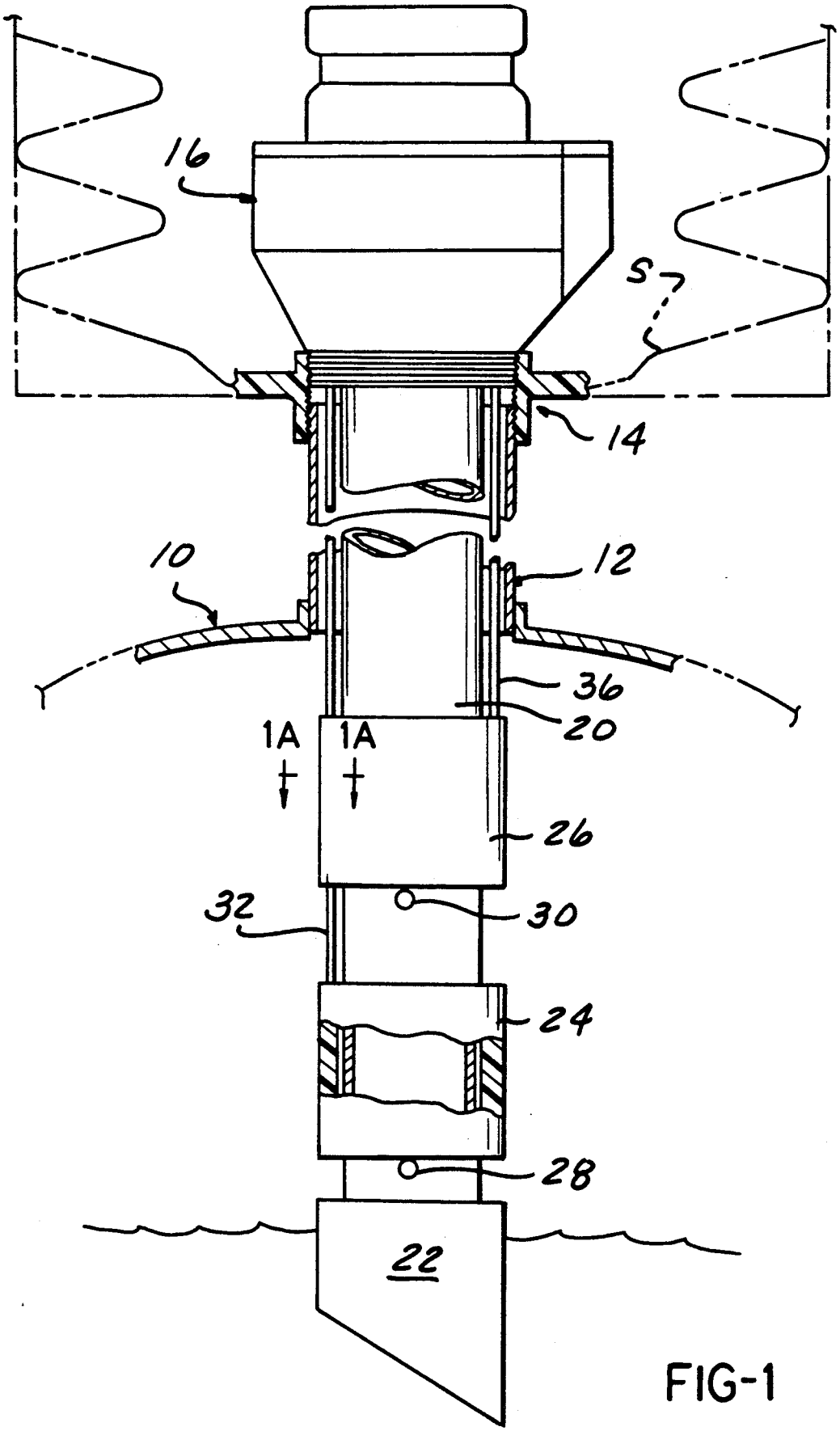
FIG. 1 is an overall side elevational view, with certain parts broken away or shown in section, of a valve assembly embodying the present invention.

The overall arrangement of a valve assembly embodying the present invention is best seen in FIG. 1. The upper portion of an underground fuel storage tank is partially shown in section is designated generally 10 and a fill pipe 12 is fixedly and sealingly secured at its lower end to tank 10 to project upwardly from the tank. A coupling or adapter member 14 is threadably and sealingly secured to the upper end of fill pipe 12 and may, as indicated in the drawings, constitute a portion of the bottom of a spill container unit indicated partially in broken line at S. See, for example, U.S. Pat. No. 4,793,387.

The valve assembly of the present invention includes a valve housing designated generally 16 which is threadably and sealingly secured into the upper end of the adapter 14. An elongate hollow drop tube 20 is secured to and projects downwardly from the bottom of housing 16 through fill pipe 12 and downwardly into the interior of tank 10 to a lower end 22 located well below the top of tank 10. Two hollow tubular floats 24, 26 are slidably received on the exterior of drop tube 20. In FIG. 1, the lower float 24 is shOWn at its lower end limit of movement on drop tube 20 which is established by the engagement between the lower end of float 24 and a slop pin 28 fixed to and projecting outwardly from drop tube 20. A similar stop pin 30 establishes the lower end limit of movement for upper float 26.

Figure 1A:
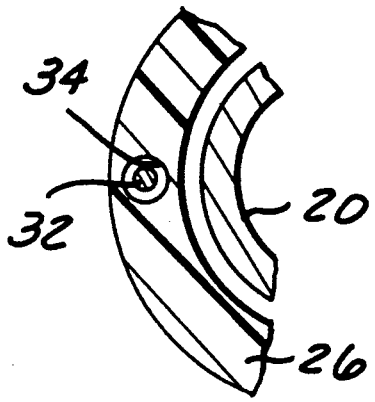

A first push rod 32 is fixedly secured at its lower end to lower float 24 and projects upwardly from float 24 freely through a bore 34 (FIG. 1A) in upper float 26 and thence, upwardly through fill pipe 12 into the lower end of valve housing 16. A second push rod 36 is fixed at its lower end to upper float 26 and projects upwardly from float 26 through fill pipe 12 into the bower end of valve housing 16.

Figure 2:
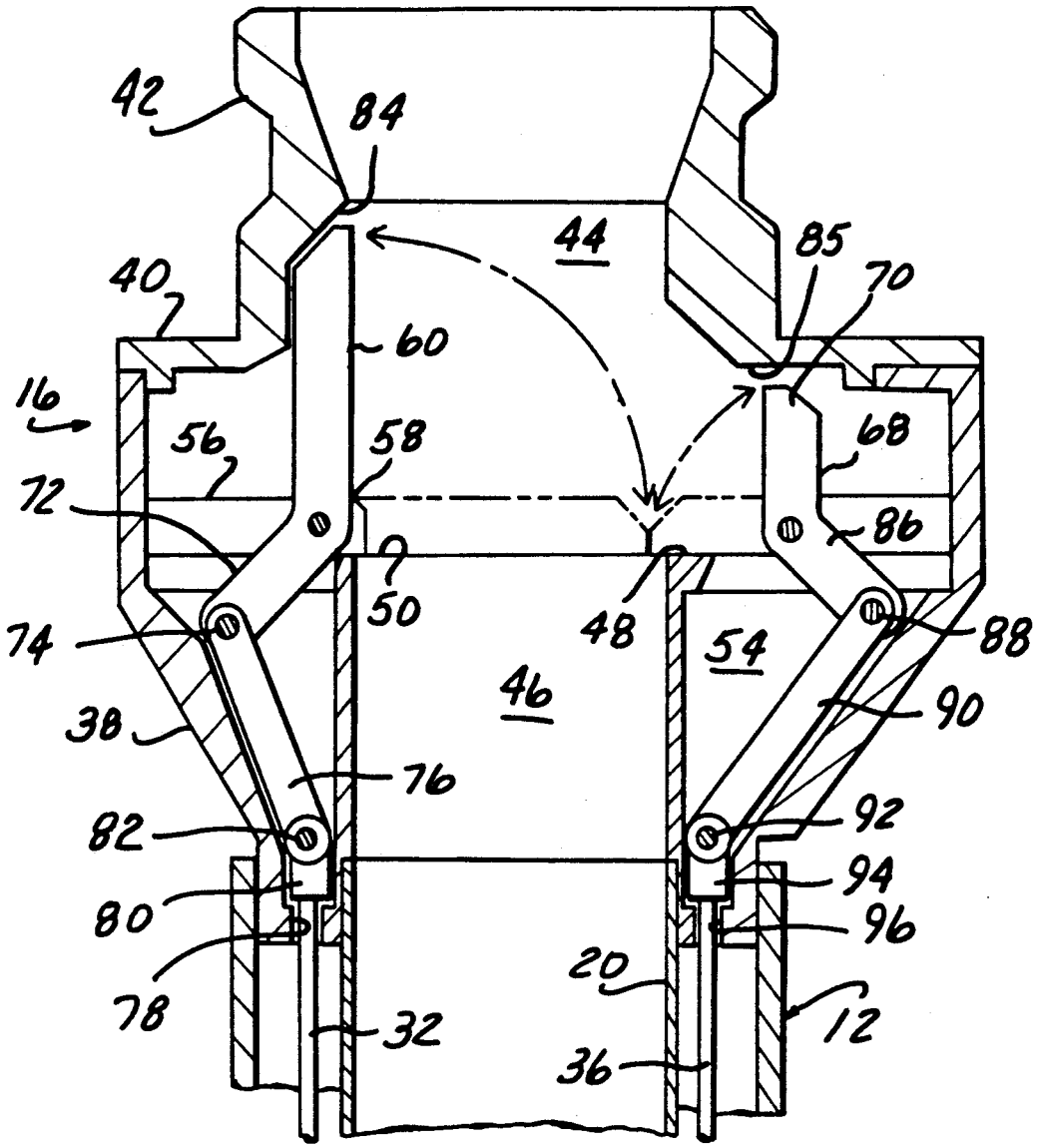
FIG. 2 is a detailed cross sectional view of the valve housing portion of the assembly of FIG. 1.

Referring now particularly to FIG. 2, it is seen that valve housing 16 includes a lower main housing portion 38 whose open upper end is closed by a cover 40 integrally formed with an upwardly projecting coupling section 42 by means of which the end of a tank truck supply hose can be sealingly secured, in a well known manner, to the valve housing to dispense fuel into the interior of the housing. An inlet chamber 44 extends downwardly through coupling section 42 and cover portion 40. Lower section 38 of the housing is formed with a centrally located flow passage 46 extending downwardly from chamber 44 to open into the upper end of drop tube 20 which is threadably received in the lower portion of lower housing 38 so that the interior of drop tube 20 defines a downward continuation of flow passage 46. An upwardly facing annular valve seal 48 is formed in housing 38 at the upper end of flow passage 46. Valve seat 48 is constituted by that portion of an upwardly facing horizontal surface 50 within housing portion 38 which surrounds the open upper end of flow passage 46.

Figure 3:
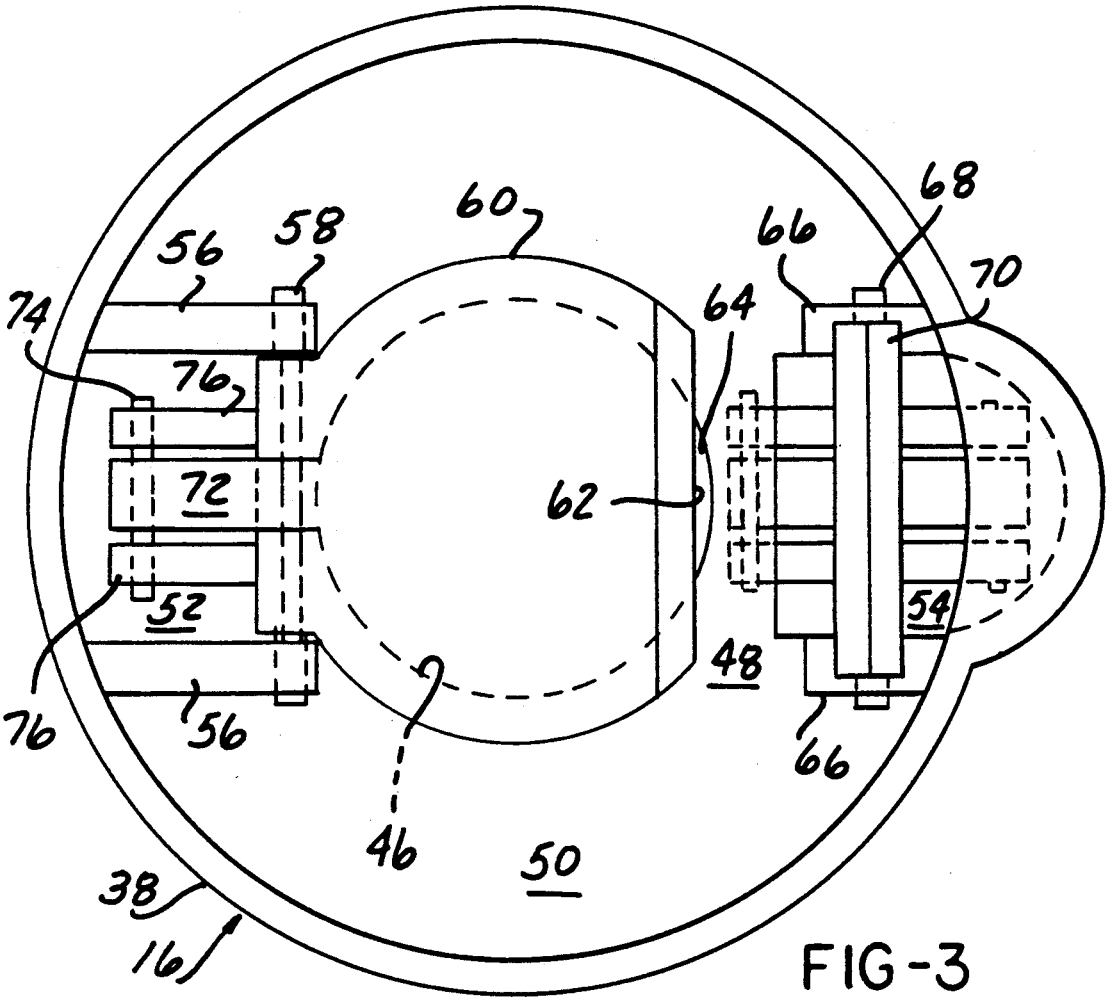
FIG. 3 is a top plan view of the valve housing with the supply hose coupler removed.

Referring now particular to FIG. 3, at diametrically opposed sides of flow passage 46, recesses 52, 54 extend downwardly through the horizontal surface 50 to provide, as best seen in FIG. 2, an enlarged passage for valve actuating linkage to be described in greater detail below. As best seen in FIG. 3, at each side of recess 52, webs 56 project upwardly from surface 50 in spaced parallel relationship to each other at opposite sides of recess 52 to support a pivot pin 58 at a location slightly above surface 50. A first valve flapper 60 is pivotally mounted upon pin 58 for pivotal movement between an open position, shown in full line FIG. 2, in which the flapper extends vertically upwardly from pin 58 and a closed position in which flapper 60, as indicated in broken line in FIG. 2, extends horizontally from pivot 58 with the lower side of flapper 60 seated on the valve seat portion 48 of horizontal surface 50.

In FIG. 3, flapper 60 is shown in its closed position. The flapper generally is of circular configuration with the exception that a segment of the circles has been omitted to form a straight edge 62 (FIG. 3) so located that when flapper 60 is in its closed position, a small portion 64 of flow passage 46 is not covered by flapper 60.

A second pair of webs 66 project upwardly from horizontal surface 60 at the opposite sides of the second recess 54 to support a pivot pin 68 which in turn pivotally mounts a second valve flapper 70 for pivotal movement. In FIG. 2, the second flapper 70 is shown in full line in its open position, it is pivotable about the axis of pin 68 to the closed position indicated in broken line in FIG. 2, and, when flapper 70 is in its closed position, it overlies and blocks that portion 64 of flow passage 46 (FIG. 3) which is not blocked by the closed first flapper 60.

Flapper 60 is formed with an integral crank arm 72 pivotally connected at its distal end by a pin 74 to a pair of links 76. As best seen in FIG. 2, the push rod 32 which projects upwardly from lower float 24 passes through a bore 78 in the lower end of housing portion 38 and is coupled as by a fitting 80 fixed to the upper end of rod 32 and a pivot pin 82 to the lower end of link 76. In FIG. 2, push rod 32 is shown at its lower end limit of movement which corresponds to the position of lower float 24 shown in FIG. 1. The unsupported weight of float 24 and push rod 32 is sufficient to gravitationally hold flapper 60 in the open position shown in full line in FIG. 2. If the level of fuel within storage tank 10 should rise to a level sufficient to lift float 24 upwardly, upward movement of push rod 32 is transmitted via link 76 to crank 72 to pivot flapper 60 in a clockwise direction about the axis of pin 58.

As best seen in FIG. 2, the flow passage through cover - coupling section 40, 42 is provided with an overhanging recess as at 84 so that when fuel is flowing downwardly through chamber 44, the open flapper 60 is withdrawn clear of and shielded from the downwardly flowing stream of fuel. A similar recess 85 shields flapper 70 from the downwardly flowing fuel stream when flapper 70 is in its open position. When the incoming fuel rises within storage tank 10 to a level which lifts float 24, the initial lifting of the float will, via the upwardly moving push rod 32, link 76 and crank 72 pivot flapper 60 in a clockwise direction from the closed position as viewed in FIG. 2. The initial movement of flapper 60 away from its closed position moves the upper edge of the flapper into the path of incoming fuel, and this downwardly moving flow of fuel will rapidly drive flapper 60 to the closed position. The force of the incoming fuel flow upon flapper 60 is sufficient to lift the float 24 so that valve 60 is driven to its closed position sooner than would be the case where the valve position was determined by the float position.

Similarly, the second flapper 70 is formed with an integral crank 86 pivotally coupled as by pivot pin 88 to links 90 whose opposite ends are pivotally coupled as by pin 92 to a fitting 94 fixedly secured to the upper end of push rod 36 which is slidably received within a second bore 96 through the lower end of housing 38.

Figure 4:
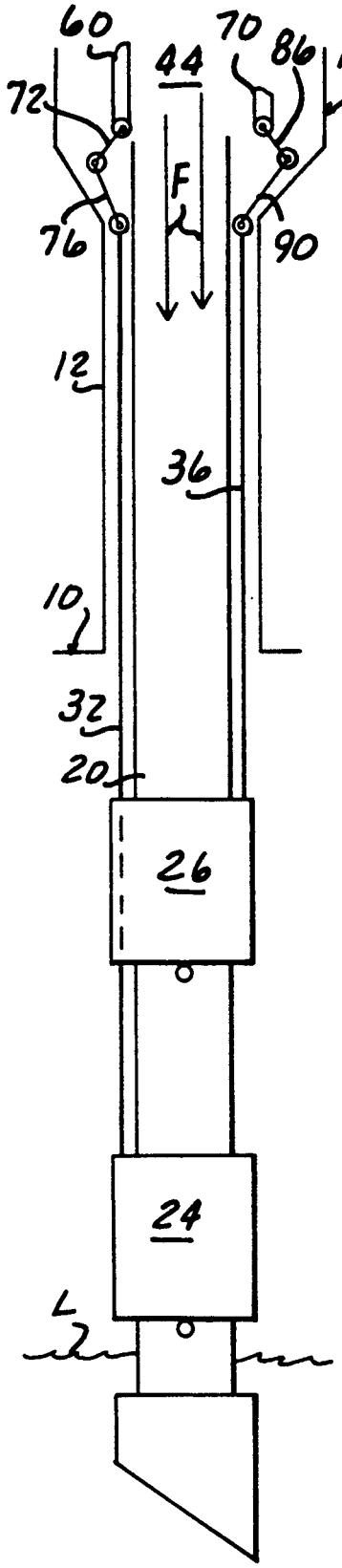
FIGS. 4, 5 and 6 are schematic diagrams showing successive steps in the two stage actuation of the valve.

Operation of the valve assembly described above is best understood from the schematic diagrams of FIGS. 4. 5 and 6.

In FIG. 4, it will be assumed that a tank truck supply hose is connected to the coupling at the upper end of the valve housing and fuel is flowing downwardly as indicated by the arrows F through the valve housing and drop tube 20 into the interior of tank 10. In FIG. 4, the level L of fuel within the tank, which is rising, is still below lower float 24, and thus lower floats 24 and 26 are in their lowermost position and their push rods, coupled via the respective linkages 76, 72 to flapper 60 and 90, 86 to flapper 70, locate the flappers 60 and 70 in their open position. With both flappers opened, fuel flows into tank 10 at a rate of flow which typically is 300 or more gpm.

Figure 5:
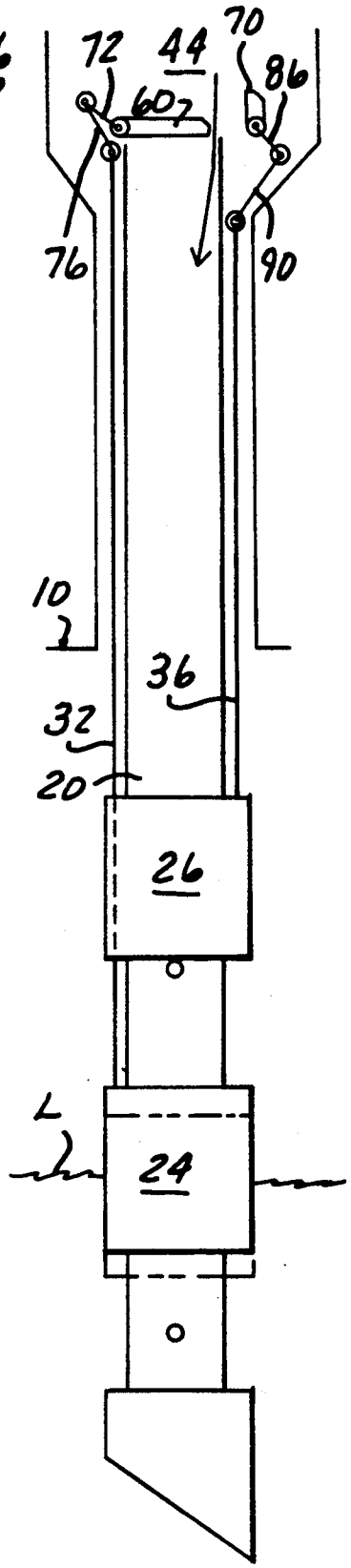

As the level L of fuel within the tank rises from that shown in FIG. 4 to that indicated in FIG. 5, lower float 24 at some point begins to rise, elevating its push rod 32 which, as described above, acts through link 76 and crank 72 to pivot flapper 60 from its opened position outwardly into the path of fuel flowing downwardly through the valve assembly. As soon as flapper 60 begins to move into the downwardly flowing stream F of fuel, the force of this downward flow drives flapper 60 forceably to its closed position. When flapper 60 is closed, as best seen in FIG. 2, only a small portion 64 of the flow passage remains open, and this sudden reduction or restriction to the flow passage generates a water hammer effect which will be audible to the fuel delivery man. This signal tells him that the tank is nearly filled. The lowermost end limit of movement of lower float 24 typically will be chosen such that the lower float is lifted to trigger actuation of flapper 60, as described above, when the tank is approximately 95% full. The cross sectional area of the flow passage through the valve (area 64, FIG. 3) which remains open after flapper 60 has been closed is typically chosen to be about 10% of the cross sectional area of flow so that, upon closure of flapper 60, the rate of flow of fuel into the tank is reduced by 90%, say to a flow of 30 to 40 gpm as compared to a full flow rate of 300 to 400 gpm.

The setting of the lower limit of upper float 26 may be chosen to be such that float 26 triggers the second flapper 70 to its closed position at some level, such as 98% of tank capacity, which will afford ample time after flapper 60 has closed for the delivery man to shut off the flow of incoming fuel before flapper 70 is triggered. If, for example, float 24 triggers flapper 60 when the tank is 95% full, and float 26 is set to trigger flapper 70 when the tank is 98% full, for a 10,000 gallon capacity tank, an additional 300 gallons of fuel can be put into the tank after flapper 60 has been triggered. At a reduced flow rate of 30 to 40 gpm, the restricted inlet flow rate after closure of flapper 60, the delivery man has several minutes to shut off the flow of incoming fuel while leaving ample capacity within the tank to drain the supply hose through the restricted opening 64.

Figure 6:
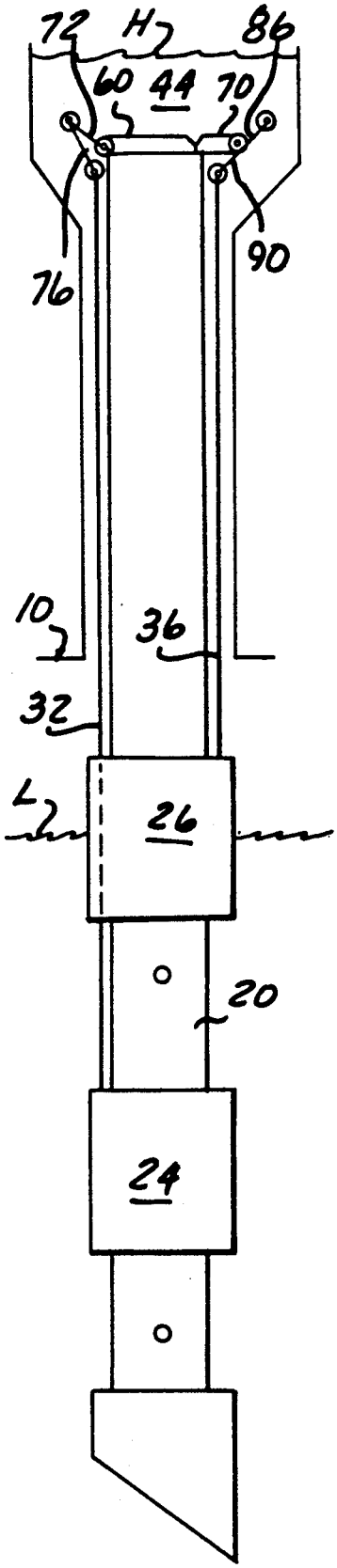

If, for some reason, the delivery man does not shut off the incoming flow in time, and the level of fuel within the tank 10 rises to a level at which upper float 26 is elevated to actuate flapper 70 to its closed position, closure of both flapper 60 and flapper 70, as indicated in FIG. 6, completely blocks flow of fuel into the upper end of drop tube 20, and traps all fuel in the line between the closed flappers 60, 70 and the shut off valve in the tank truck. This trapped fuel, once the tank truck shut off valve is closed, can be drained by uncoupling the supply hose from coupling portion 42 and draining the supply hose into the spill container S.

As described above in connection with the closure of flapper 60, float 26 has to be buoyed up by the fuel within the tank only by a very small amount before its push rod 36 acts through link 90 to shift flapper 70 outwardly into the path of downwardly flowing fuel, and this downward flow of fuel acting on top of flapper 70 drives flapper 70 to its closed position and, in so doing, acts through link 90 and push rod 36 to lift upper float 26 upwardly above the position to which it would be buoyed by the level L of fuel within tank 10. Thus, at the time flapper 70 is closed, the entire weight of the float and push rod is not supported by the fuel in the tank, and there is a gravitational bias urging flapper 70 toward its open position. This bias is not sufficient to open flapper 70 against the static head within the valve housing and tank truck supply hose, but is sufficient to open flapper 70 against the static head M (FIG. 6) within the valve housing alone. Once the supply hose is uncoupled and drained as described above, flapper 70 is gravitationally biased open to drain fuel trapped in inlet chamber 44 into the storage tank.

Figure 7:
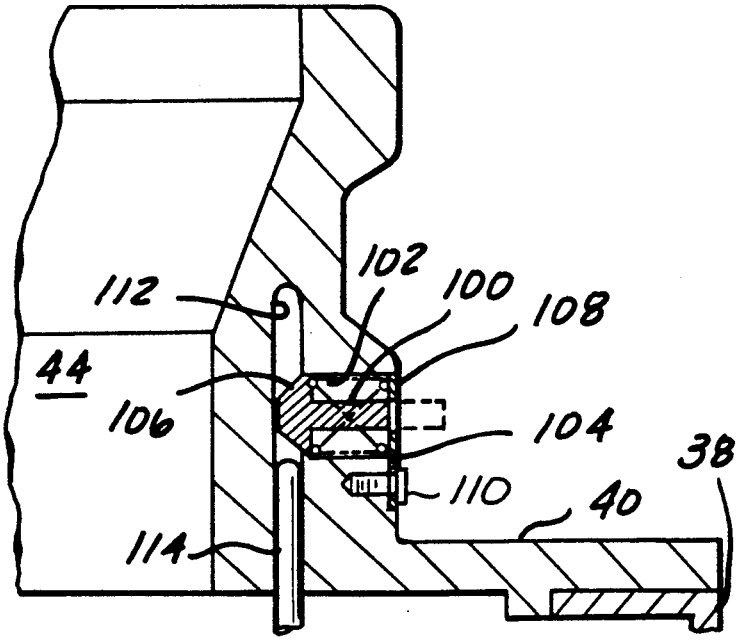
FIG. 7 is a detailed cross sectional view showing a lock out pin device.

In FIG. 7, a lock out device for preventing the coupling of a supply hose to the valve when the storage tank is substantially full is disclosed. A lockout pin 100 is mounted within a bore 102 in housing cover 40 and normally maintained withdrawn into the housing by a compression spring 104 engaged between the head 106 of pin 100 and a plate 108 overlying the outer end of bore 102 and fixed to cover 40 as by a bolt 110.

When in this position, the chamfered head 106 of pin 100 projects into a second bore 112 extending upwardly into cover 40. A push rod projects upwardly into bore 112 and extends downwardly through the valve housing in the same fashion as push rod 32, 36 to a float (not shown) slidably mounted on drop tube 20 in the same manner as floats 24, 26.

The float coupled to push rod 114 typically will be mounted below float 24 to be buoyed up by fuel in the tank when the fuel level is below that at which lower float 24 is buoyed up. It is believed apparent that upward movement of push rod 114 from the position shown in FIG. 7 will cam pin 100 outwardly through a bore 116 in plate 108 to the projecting broken line position indicated in FIG. 7. The projecting pin will prevent a supply hose coupling from being fully seated on and coupled to the valve housing.

During a normal filling operation commenced with a fuel level in the tank below that at which push rod 114 would be elevated from the position shown in FIG. 7, pin 100 is retracted and a portion of the supply hose coupling overlies bore 116 in plate 108. As the fuel level rises to a level at which rod 114 is elevated, the rod engages head 106 of the pin, but cannot cam the pin outwardly because the seated hose coupling prevents this outward movement of the pin. When the hose is uncoupled, the level of fuel within the tank will be well above the pin actuating level and the pin will be driven outwardly to its lock out position as soon as the restraint imposed by the hose coupling is removed. The pin will remain projected until the level of fuel in the tank drops sufficiently to permit rod 114 to move downwardly out of engagement with the head 106 of pin 100.

While on embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. A shut off valve assembly for shutting off the flow of fluid into and lo prevent overfilling of said tank, said tank having a storage tank, an inlet pipe projecting upwardly from the top of said tank, said valve assembly comprising a valve housing mounted at the upper end of said inlet pipe, an elongate drop tube fixed at its upper end to said housing and projecting downwardly from said housing through said inlet pipe into said tank to an open lower end located substantially below the top of said tank, means defining a fluid inlet chamber at the upper end of said housing for receiving fluid under pressure from a fluid supply source and a fluid flow passage extending downwardly from said chamber through said housing and said drop tube for conducting fluid from said inlet chamber into said tank tube, a first hollow tubular float slidably received upon said drop tube adjacent the lower end thereof, a second hollow float slidably received upon said drop lube at a location spaced above said first float and below the top of said tank, a first valve flapper pivotally mounted in said inlet chamber adjacent the upper end of said flow passage for pivotal movement between an open position clear of said flow passage and a closed position wherein said first valve flapper overlies and blocks a major portion of said flow passage, a second valve flapper mounted in said inlet chamber adjacent the upper end of said flow passage for movement between an open position clear of said flow passage and a closed position wherein said second valve flapper overlies and blocks a minor portion of said flow passage, said first and second valve flappers when in their respective closed positions cooperatively blocking all fluid communication between said inlet chamber and said flow passage, first and second flapper actuating means respectively coupled between said first and second floats and and said first and second valve flappers for normally locating said first and second flappers in their respective open positions when the level of fluid within said tank is below a preselected first level and for pivoting said first flapper toward its closed position when the level of fluid within said tank rises above said first level and for pivoting said second flapper toward its closed position when the level of fluid in said tank rises above a second level substantially above said first level for shutting off the flow of fluid into and to prevent overfilling of said tank.

2. The invention defined in claim 1 wherein the outer diameter of said first and said second floats is less than the inner diameter of said fill pipe.

3. The invention defined in claim 2 wherein said first actuating means comprises an elongate rod fixed at its lower end to said first float and extending upwardly along the exterior of said drop tube to pass freely through a bore in said second float.

4. The invention defined in claim 1 wherein said first valve flapper when in its closed position is operable to reduce the flow of fluid from said inlet chamber into said passage to approximately 10% of the flow of fluid from said inlet chamber into said flow passage when said first flapper is in its open position.

5. The invention defined in claim 1 wherein said first float and first actuating means are operable to gravitationally maintain said first flapper in its open position when the level of fluid within said tank is below said first level and said second float and second actuating means are operable to gravitationally maintain said second flapper in its open position when the level of fluid within said tank is below said second level.

6. The invention defined in claim 5 wherein said first flapper is mounted for pivotal movement about a first horizontal axis at one side of said flow passage and is inclined upwardly from said first axis at one side of the path of direct downward flow of fluid into said flow passage when said first flapper is in said open position, said first float and said first actuating means being operable in response to a rise of the level of fluid in said tank above said first level to pivot said first flapper about said first axis into said path of downward flow to be forcibly driven by said downward flow to its closed position.

7. The invention defined in claim 6 wherein said second flapper is mounted for pivotal movement about a second horizontal axis at the side of said flow passage opposite said one side and is inclined upwardly from said second axis at one side of the path of direct downward flow of fluid into said flow passage when said second flapper is in its open position, said second float and said second actuating means being operable in response to a rise in the level of fluid in said tank above said second level to pivot said second flapper about said second axis into said path of downward flow of fluid to cause said second flapper to be driven by said downward flow to its closed position more rapidly than said second flapper would have been moved to its closed position by further upward movement of said second float by the rising of the level of fluid within said tank occasioned by the incoming flow of fluid whereby said second float and second actuating means exert a gravitational bias urging the so closed second flapper toward its open position which bias is sufficient to overcome the static head of fluid in said inlet chamber upon disconnection of said fluid supply source from said chamber.

8. The invention defined in claim 1 wherein said housing includes supply hose coupling means at its upper end adapted to sealingly receive a supply hose, a blocking pin slidably received in said housing for movement between a normally maintained retracted position within said housing and an extended position wherein said pin projects from said housing to prevent a supply hose from being sealingly received by said supply hose coupling means, and float means for locating said pin in said extended position when the level of fluid within said tank is at or above a selected level.

9. A shut off valve assembly for shutting off the flow of fluid into and to prevent overfilling of a tank, said tank having a storage tank, an inlet pipe projecting upwardly from the top of said tank, said valve assembly comprising a valve housing mounted at the upper end of said inlet pipe, an elongate drop tube fixed at its upper end to said housing and projecting downwardly from said housing through said inlet pipe into said tank to an open lower end located substantially below the top of said tank, means defining a fluid inlet chamber at the upper end of said housing for receiving fluid under pressure from a fluid supply source and a fluid flow passage extending downwardly from said chamber through said housing and said drop tube for conducting fluid from said inlet chamber into said tank, a first hollow tubular float slidably received upon said drop tube adjacent the lower end thereof, a second hollow float slidably received upon said drop tube at a location spaced above said first float and below the top of said tank, a first valve flapper pivotally mounted in said inlet chamber adjacent the upper end of said flow passage fort pivotal movement between an open position clear of said flow passage and a closed position wherein said first valve flapper overlies and blocks a major portion of said flow passage, a second valve flapper mounted in said inlet chamber adjacent the upper end of said flow passage for movement between an open position clear of said flow passage and a closed position wherein said second valve flapper overlies and blocks a minor portion of said flow passage, said first and second valve flappers when in their respective closed positions cooperatively blocking all fluid communication between said inlet chamber and said flow passage, first and second flapper actuating means respectively coupled between said first and second floats and said first and second valve flappers for normally locating said first and second flappers in their respective open positions when the level of fluid within said tank is below a preselected first level and for pivoting said first flapper toward its closed position when the level of fluid within said tank rises above said first level and for pivoting said second flapper toward its closed position when the level of fluid in said tank rises above a second level substantially above said first level for shutting off the flow of fluid into and to prevent overfilling of said tank, wherein said housing includes supply hose coupling means at its upper end adapted to sealingly receive a supply hose, a blocking pin slidably received in said housing for movement between a normally maintained retracted position within said housing and an extended position wherein said pin projects from said housing to prevent a supply hose from being sealingly received by said supply hose coupling means, and means for locating said pin in said extended position when the level of fluid within said tank is at or above a selected level.

10. The invention defined in claim 9 wherein the outer diameter of said first and said second floats is less than the inner diameter of said fill pipe.

11. The invention defined in claim 10 wherein said first actuating means comprises an elongate rod fixed at its lower end to said first float and extending upwardly along the exterior of said drop tube to pass freely through a bore in said second float.

12. The invention defined in claim 9 wherein said first valve flapper when in its closed position is operable to reduce the flow of fluid from said inlet chamber into said passage to approximately 10% of the flow of fluid from said inlet chamber into said flow passage when said first flapper is in its open position.

13. The invention defined in claim 9 wherein said first float and first actuating means are operably to gravitationally maintain said first flapper in its open position when the level of fluid within said tank is below said first level and said second float and second actuating means are operable to gravitationally maintain said second flapper in its open position when the level of fluid within said tank is below said second level.

14. The invention defined in claim 13 wherein said first flapper is mounted for pivotal movement about a first horizontal axis at one side of said flow passage and is inclined upwardly from said first axis at one side of the path of direct downward flow of fluid into said flow passage when said first flapper is in said open position, said first float and said first actuating means being operably in response to a rise of the level of fluid in said tank above said first level to pivot said first flapper about said first axis into said path of downward flow to be forcibly driven by said downward flow to its closed position.

15. The invention defined in claim 14 wherein said second flapper is mounted for pivotal movement about a second horizontal axis at the side of said flow passage opposite said one side and is inclined upwardly from said second axis at one side of the path of direct downward flow of fluid into said flow passage when said second flapper is in its open position, said second float and said second actuating means being operable in response to a rise in the level of fluid in said tank above said second level to pivot said second flapper about said second axis into said path of downward flow of fluid to cause said second flapper to be driven by said downward flow to its closed position more rapidly than said second flapper would have been moved to its closed position by further upward movement of said second float by the rising of the level of fluid within said tank occasioned by the incoming flow of fluid whereby said second float and second actuating means exert a gravitational bias urging the so closed second flapper toward its open position which bias is sufficient to overcome the static head of fluid in said inlet chamber upon disconnection of said fluid supply source from said chamber.

* * * * *

UNITED STATES PATENT AND TRADEMARK OFFICE

CERTIFICATE OF CORRECTION

PATENT NO. : 5,010,915

DATED : April 30, 1991

INVENTOR(S) : Bruce Johnson and Robert Whitney

It is certified that error appears in the above-identified patent and that said Letters Patent is hereby corrected as shown below:

Column 3, line 4 after "section", insert --and--

Column 3, line 34 change "bower" to --lower--

Column 3, line 51 change "seal" to --seat--

Column 4, line 8 change "circles" to --circle--

Column 6, line 65 change "on" to --one--

Column 7, rewrite lines 5 and 6 to read as follows:

--of fluid into a storage tank to prevent overfilling of said tank, said tank having an inlet pipe projecting--

Column 7, line 18, delete "tube"

Column 8, rewrite lines 49 and 50 to read as follows:

--of fluid into a storage tank to prevent overfilling of said tank, said tank having an inlet pipe projecting--

Signed and Sealed this

Twenty-second Day of December, 1992

*Attest:*

DOUGLAS B. COMER

*Attesting Officer*

*Acting Commissioner of Patents and Trademarks*